United States Patent [19]

Kishi et al.

[11] Patent Number: 4,585,723

[45] Date of Patent: Apr. 29, 1986

[54] DEVELOPER FOR ELECTROSTATIC LATENT IMAGE AND METHOD OF FORMING IMAGE

[75] Inventors: Ken-ichi Kishi, Sagamihara; Keiji Sato; Takahira Kasuya, both of Hachioji; Kunio Ito, Tama; Tsuneo Wada, Sagamihara, all of Japan

[73] Assignee: Konishiroku Photo Industry Co., Ltd., Tokyo, Japan

[21] Appl. No.: 767,056

[22] Filed: Aug. 19, 1985

Related U.S. Application Data

[63] Continuation of Ser. No. 461,879, Jan. 28, 1983, abandoned.

[30] Foreign Application Priority Data

Feb. 3, 1982 [JP] Japan ..... 57-14731
May 25, 1982 [JP] Japan ..... 57-87222

[51] Int. Cl.[4] ..... G03G 9/08; G03G 9/10; G03G 9/14

[52] U.S. Cl. ..... 430/106; 430/106.6; 430/110; 430/137

[58] Field of Search ..... 430/106, 106.6, 109, 430/110, 137

[56] References Cited

U.S. PATENT DOCUMENTS 3,720,617 3/1973 Chatterji et al. ..... 430/110
4,051,077 9/1977 Fisher ..... 430/110
4,288,517 9/1981 Arimatsu et al. ..... 430/110
4,395,485 7/1983 Kashiwagi et al. ..... 430/106.6 X

FOREIGN PATENT DOCUMENTS 56-128956 10/1981 Japan ..... 430/110

*Primary Examiner*—Roland E. Martin
*Attorney, Agent, or Firm*—Jordan B. Bierman

[57] ABSTRACT

A developer for developing an electrostatic latent image comprising colored electroscopic particles and at least one silicon dioxide powder having its particles made hydrophobic with a specified organosilicon compound is disclosed. Silicon atoms in said organosilicon compound are bonded to silicon atoms on the surface of individual silicon dioxide particles through oxygen atoms. At least one organic group in the organosilicon compound has a total carbon number of 8 or more and is a saturated or unsaturated aliphatic organic group with at least 5 carbon atoms or an organic compound having a hydrocarbon ring. In a preferred embodiment, such a silicon dioxide powder is used in combination with another silicon dioxide powder whose particles are rendered hydrophobic by an organosilicon compound wherein any of the organic groups present has a total carbon number of 7 or less and is a saturated or unsaturated organic group with not more than 4 carbon atoms or an organic group having a hydrocarbon ring.

29 Claims, 1 Drawing Figure

DEVELOPER FOR ELECTROSTATIC LATENT IMAGE AND METHOD OF FORMING IMAGE

This application is a continuation of Ser. No. 461,879, filed Jan. 28, 1983, now abandoned; which claims the priority of Japanese No. 14,731/82, filed Feb. 3, 1982 and 87,222/82, filed May 25, 1982.

FIELD OF THE INVENTION

The present invention relates to a developer for developing an electrostatic latent image formed in electrophotography, electrostatic recording and electrostatic printing, as well as to a method of forming an image with said developer.

BACKGROUND OF THE INVENTION

Techniques of forming a visible image from video information by way of an electrostatic latent image are currently in wide use. Electrophotography, a typical example of these techniques, consists essentially of a charging and exposure step wherein an electrostatic latent image formed on a support made of a photoconductive photoreceptor is developed with a developer made of colored electroscopic particles, a transfer step wherein the resulting toner image is transferred and fixed to a receiving sheet to form a visible image, and a post-imaging step wherein the support having the transferred image is cleaned in preparation for another cycle of image formation.

Several requirements must be met to form visible images of consistent quality over an extended period, and the developer used in developing an electrostatic latent image must also satisfy certain conditions. Conventionally, the developer is made of a powder of electroscopic colored particles having a colorant dispersed in a binder resin (this powder is hereunder referred to as a toner powder). To form a visible image of good quality, the developer must have high fluidity, and for this purpose, the conventional toner powder contains fine particles of silicon dioxide. But raw fine particles of silicon dioxide are hydrophilic and the developer containing them experiences block ing (individual particles agglomerate) due to the moisture of air with the result that its fluidity is decreased. To avoid this problem, proposals have been made for using fine particles of silicon dioxide after they have been rendered hydrophobic see Japanese patent applications (OPI) Nos. 5782/71, 47345/73 and 47346/73 (the symbol OPI as used herein means an unexamined published Japanese patent application) . According to these proposals, silicon dioxide particles and an organosilicon compound such as dimethyl dichlorosilane are fed concurrently with water vapor by an inert gas such as nitrogen into a reactor filled with a heated fluidized bed, thereby reacting the silanol groups on the silicon dioxide particles with the organosilicon compound to render the silicon dioxide particles hydrophobic. But the hydrophobicity obtained is not satisfactory; in a hot and humid atmosphere, the toner particles have a tendency to agglomerate and their fluidity is decreased. In addition, wet toner particles easily let leak static charges and the reduced charge buildup leads to a visible image of impaired quality.

The conventional particles of hydrophobic silicon dioxide are considerably hard and have a great chance to damage the support for an electrostatic latent image. This is conspicuous when the support is made of a selenium-tellurium system or an organic photoconductive material and is relatively soft. A support made of a selenium-arsenic system which is relatively hard but is very vulnerable to mechanical shock is also liable to be damaged. The damage to the support is particularly great when the support is subjected to high-speed contact cleaning wherein it is cleaned with a conforming wiper blade or a fur brush. If the damage to the support goes to an extreme, the blade or fur brush is also damaged to make further cleaning difficult.

As well known, the deposition of toner particles on the support and subsequent damage to its surface can be effectively prevented by adding a lubricant such as a fatty acid metal salt (e.g. zinc stearate) to the toner powder. Since the fluidity of the toner containing a lubricant is appreciably reduced, the addition of fine silicon dioxide particles is generally necessary. But then a toner containing both a waxy lubricant and fine silicon dioxide particles has a particularly great tendency to damage the support. This defect is especially conspicuous when the support is made of a relatively soft material such as a selenium-tellurium system or an organic photoconductive material or a hard but brittle material such as a selenium-arsenic system, or when the support is cleaned with a conforming a doctor blade or a fur brush.

As described above, the conventional toner containing fine particles of hydrophobic silicon dioxide becomes less fluid with time and experiences blocking. In addition, the toner presents damage to the support for an electrostatic latent image. Therefore, it is difficult to produce visible images of consistent quality with this toner over an extended period.

SUMMARY OF THE INVENTION

A general object of the present invention is to provide a developer for latent electrostatic image that is capable of producing visible images of consistently excellent quality over an extended period.

Another object of the present invention is to provide a developer for latent electrostatic image that will, under any environmental conditions, exhibit excellent characteristics without experiencing reduced fluidity and blocking.

Still another object of the present invention is to provide a method of forming an image including development, fixing and cleaning steps that is capable of producing visible images of consistently excellent quality over an extended period.

A further object of the present invention is to provide a method of forming an image that will produce visible images of consistently excellent quality over an extended period under any environmental conditions and irrespective of the cleaning method or the type of the support for an electrostatic latent image.

These objects of the present invention can be accomplished by a developer for developing an electrostatic latent image comprising colored electroscopic particles and a first silicon dioxide powder wherein a silicon atom having at least one organic group (A) is bonded to a silicon atom on the surface of an individual silicon dioxide particle through an oxygen atom, at least one of said organic group (A) being a saturated or unsaturated aliphatic organic group with 5 or more carbon atoms or an organic group having a hydrocarbon ring with the total carbon number of said organic group being 8 or more. The objects can also be accomplished by a method of forming an image including the step of developing an electrostatic latent image on a support with the above described developer to form a visible image and the step of transferring and fixing the visible image to a receiving sheet. In a preferred embodiment, the developer comprises colored electroscopic particles, the first silicon dioxide powder, and a second silicon dioxide powder wherein a silicon atom having at least one organic group (B) is bonded to a silicon atom on the surface of an individual silicon dioxide particle through an oxygen atom, any of said organic group (B) being a saturated or unsaturated aliphatic organic group with 4 or less carbon atoms or an organic group having a hydrocarbon ring with the total carbon member being 7 or less.

BRIEF DESCRIPTION OF THE DRAWING

The accompanying drawing illustrates schematically the construction of an electrophotocopier for carrying out the process of electrophotography.

DETAILED DESCRIPTION OF THE INVENTION

Figure 1:
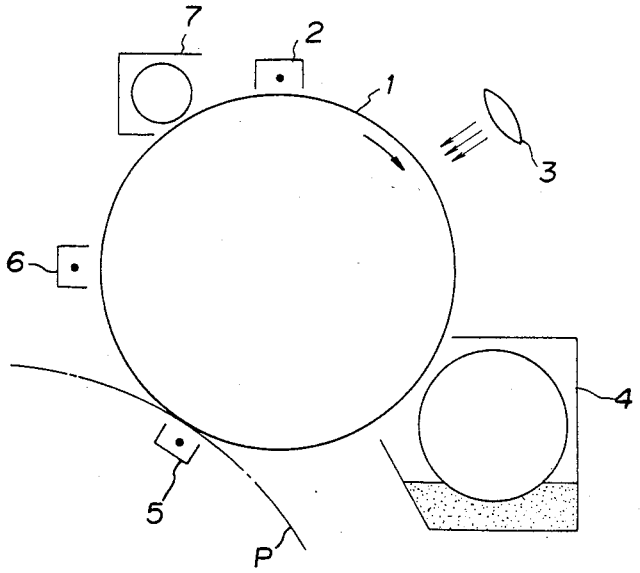

The first silicon dixoide powder as used in the present invention is such that a silicon atom having organic group (A) is chemically bonded to a silicon atom on the surface of an individual silicon dioxide particle through an oxygen atom. When the silicon atom with organic group (A) is represented by $R^1Si$, $R^1R^2Si$ or $R^1R^2R^3Si$, $R^1$ is a saturated or unsaturated aliphatic organic group having 5 or more carbon atoms, or $R^1$ has at least one hydrocarbon ring, with the total carbon number of said organic group being 8 or more. Organic group $R^1$ is hereunder referred to as a higher organic group. The symbols $R^2$ and $R^3$ each represents a hydrogen, a saturated or unsaturated aliphatic organic group, or a non-hydrophilic organic group having a hydrocarbon ring. When $R^1$ is a saturated or unsaturated aliphatic organic group, it may have at least 5 carbon atoms, preferably at least 6 carbon atoms, and more preferably at least 8 carbon atoms. $R^1$, $R^2$ and $R^3$ may be the same or different from each other. Preferred saturated or unsaturated aliphatic organic groups include an alkyl group, an alkenyl group and the like, the upper limit of the number of carbon atoms of which is optional, but is preferably up to 22. Also, preferred organic groups having at least one hydroxarbon ring with the total carbon number being 8 or more include a naphthyl group, a substituted phenyl group, an 8- to 10- membered saturated hydrocarbon ring and the like. The substituents for said substituted phenyl group should have a total of 8 or more carbon atoms, preferably including an alkyl group or an alkenyl group each having 3 to 22 carbon atoms.

The first silicon dioxide powder can be prepared by reacting a silicon dioxide powder having a silanol group as a silicon atom on the surface of an individual particle with an organosilicon compound represented by the formula $R^1R^2R^3SiX$, $R^1R^2SiX_2$ or $R^1SiX_3$ (wherein X is a halogen such as a chlorine, an alkoxy group such as methoxy, ethoxy, propoxy, or propyloxy, an acyloxy group such as acetoxy, an amino group or the like). As a result, the silicon atom of the formula $R^1R^2R^3Si$, $R^1R^2Si$ or $R^1Si$ is bonded to a silicon atom on the surface of an individual silicon dioxide particle through an oxygen atom. If the organosilicon compound used has the formula the silicon atom $R^1R^2R^3SiX$, the silicon atom $R^1R^2R^3Si$ is presumably bonded to a single silicon atom on an individual silicon dioxide particle through an oxygen atom. If the organosilicon compound has the formula $R^1R^2SiX_2$, the reactions involved would be not only the bonding of $R^1R^2Si$ to two surface silicon atoms through an oxygen, but also the bonding to silicon atoms in the molecle of other organosilicon compound, as well as to those silicon atoms which have been bonded to surface silicon atoms. More reactions will take place if the organosilicon compound has the formula $R^1SiX_3$.

Illustrative organosilicon compounds for use in rendering the first silicon dioxide powder hydrophobic are listed below. Those which are represented by $R^1SiX_3$ are octyltrichlorosilane, decyl-trichlorosilane, nonyltrichlorosilane, (4-t-propylphenyl)-trichlorosilane and (4-t-butylphenyl)-trichloro-silane. Those which are represented by $R^2R^2SiX_2$ are dipentyl-di-chlorosilane, dihexyl-dichlorosilane, dioctyl-dichlorosilane, dinonyldichlorosilane, didecyl-dichlorosilane, didodecyldichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane and di-3,3-di-methylpentyldichlorosilane. Those which are represented by $R^1R^2R^3SiX$ include trihexyl-chlorosilane, trioctylchlorosilane, tridecyl-chlorosilane, dioctyl-methylchlorosilane, octyl-dimethyl-chlorosilane, and (4-t-propylphenyl)-diethyl-chlorosilane. Organo-silicon compounds wherein X is other than a halogen atom are listed below:

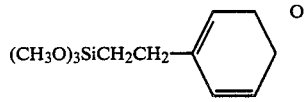

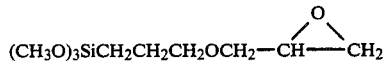

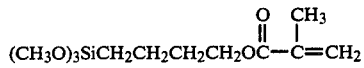

$(CH_3O)_2CH_3SiCH_2CH_2CH_2NHCH_2CH_2NH_2$ $(CH_3O)_3SiCH_2CH_2CH_2NHCH_2CH_2NH_2$

In a preferred embodiment, the developer comprises the electro-scopic colored particles (i.e. toner particles), the first silicon dioxide powder, and the second silicon dioxide powder. The second silicon dioxide powder as used in combination with the first silicon dioxide powder is such that when a silicon atomic group having an organic group (B) is represented by $R^4Si$, $R^4R^5Si$ or $R^4R^5R^6Si$, each of $R^4$, $R^5$ and $R^6$ is an organic group selected from among a saturated aliphatic organic group having not more than 4 carbon atoms, an unsaturated aliphatic organic group having not more than 4 carbon atoms and an organic group having a hydrocarbon ring with total carbon number being not more than 7 (such organic group is hereunder referred to as a lower organic group). Alternatively, $R^4$ as bonded to Si is a lower organic group and $R^5$ or $R^6$ may be a hydrogen atom. Groups $R^4$, $R^5$ and $R^6$ may be the same or different from each other. Like the first silicon dioxide powder, the second silicon dioxide powder can be prepared by reacting a silicon dioxide powder having a silanol group as a surface silicon atom with an organosilicon compound represented by $R^4SiX_3$, $R^4R^5SiX_2$ or $R^4R^5R^6SiX$. As a result, the hydrogen atom in the silanol group formed by silicon atoms on the surface of an individual silicon dioxide particle is substituted by $R^4Si$, $R^4R^5Si$ or $R^4R^5R^6Si$ to provide a hydrophobic silicon dioxide powder wherein the respective silicon atom is bonded to a surface silicon atom through an oxygen atom. Preferred saturated aliphatic organic groups having 4 or less carbon atoms include an alkyl group with 1 to 4 carbon atoms, and preferred unsaturated aliphatic organic groups having 4 or less carbon atoms include an alkenyl group with 2 to 4 carbon atoms. Further, preferred organic groups having a hydrocarbon ring with the total carbon number being 7 or less include a 3- to 7-membered saturated hydrocarbon ring, a phenyl group, a phenyl group substituted with a halogen, methoxy or methyl or a benzyl group. Also, the above-mentioned respective groups include those substituted with atoms or groups other than hydrocarbon groups, for example, halogen, an amino group and the like.

Preferred organosilicon compounds for use in rendering the second silicon dioxide powder hydrophobic and those wherein X is a halogen and typical examples are listed below. Those which are represented by $R^4SiX_3$ are methyl trichlorosilane, α-chloroethyl trichlorosilane, β-chloroethyl trichlorosilane, chloromethyl trichlorosilane, p-chlorophenyl trichlorosilane and 3-chloropropyl trichlorosilane. Those which are represented by $R^4R^5SiX_2$ are dimethyl dichlorosilane, allylphenyl dichlorosilane and divinyl dichlorosilane. Those which are represented by $R^4R^5R^6SiX$ are trimethyl chlorosilane, allyldimethyl chlorosilane, benzyldimethyl chlorosilane, bromomethyldimethyl chlorosilane, chloromethyldimethyl chlorosilane and dimethylvinyl chlorosilane. Organosilicon compounds wherein X is other than a halogen include trimethyl methoxysilane, dimethyl dimethoxysilane, dimethyl diethoxysilane, vinyl trimethoxysilane, vinyl triethoxysilane, vinyl-tris (β-methoxyethoxy)-silane, 3-chloropropyl trimethoxysilane, vinyl triacetoxysilane, hexamethyl disilazane, hexamethyl disiloxane, octamethyl cylotetrasiloxane and $(CH_3O)_3SiCH_2CH_2CH_2SH$.

For details of the process for the synthesis of compounds represented by $R^1R^2R^3SiCl$, $R^1R^2SiCl_2$, $R^4R^5R^6SiCl$ or $R^4R^5SiCl_2$, see Metallorganische Verbindungen Si in Methoden der Organischen Chemie 13/5, Houlen-Weyl, GEORG THIEME VERLAG, STUTTGART, 1980. This reference also has detailed discussion on the reaction between these halogen-organosilanes and the silanol group in silicon compounds, and it will be easy for those skilled in the art to obtain useful organosilicon compounds.

Preferably, both the first and second silicon dioxide powders have an average particle size in the range of from 1 to 100 mμ. Particles whose size exceeds 100 mμ have a tendency to damage the support for latent electrostatic image, and those whose size is less than 1 mμ are difficult to handle because they are very easily scattered in air.

Whether the first hydrophobic silicon dioxide powder is used alone or in combination with the second hydrophobic silicon dioxide powder, the proportion of the silicon dioxide powder to the toner powder is in the range of from 0.01 to 15 wt %. If the proportion exceeds 15 wt %, there is no commensurate advantage and on the contrary, the characteristics of the resulting developer may be impaired. If the proportion is less than 0.01 wt %, the desired advantages of the present invention will not always be assured. When the first and second silicon dioxide powders are used in combination, the weight ratio of the two powders is within the range of from 9:1 to 1:9. If either powder is less than a tenth of the total silicon dioxide powder, the advantages of using the two types of silicon dioxide powder are not assured.

By incorporating only the first silicon dioxide powder in toner particles, a developer for latent electrostatic image having improved resistance to moisture and reduced chance to damage the support for latent electrostatic image can be produced. By incorporating not only the first silicon dioxide powder but also the second silicon dioxide powder in toner particles, a developer having increased fluidity in addition to the stated two advantages can be produced.

Any toner powder can be used in the present invention. As already mentioned, a toner powder is usually such that a colorant and additives are dispersed in particles made of a binder resin, and the average toner particle size is generally from 5 tp 30μ. Any conventional binder resin can be used, and typical examples are those which contain carboxylic acids or their derivatives in the molecule, for example, a styrene resin, an acrylic resin, a styrene-acrylic copolymer resin, a polyester resin, an epoxy resin, a xylene resin, a phenolic resin and a vinyl chloride-vinyl acetate copolymer resin. Preferred examples are a styrene-acrylic resin, a polyester resin, mixtures with themselves or other resins.

The probable reason why the toner powder using as a binder resin the one having a carboxylic acid or its derivative in the molecule is as follows. The conventional hydrophobic silicon dioxide, like the second silicon dioxide used in the present invention, is not satisfactorily hydrophobic and contains many unreacted silanol groups, or the substituents having reacted with silanol groups form an atomic group not large enough to block the hydrophilicity of other unreacted silanol groups. As a result, the silanol groups form a stable hydrogen bond with the carbonyl groups in the binder resin in toner particles and ambient moisture, and the developer becomes highly sensitive to moisture. In contrast, when the first silicon dioxide according to the present invention is used alone or in combination with the second silicon dioxide, the hydrophilicity of any unreacted silanol group is blocked since the substituents that have reacted with other silanol groups form a satisfactorily large atomic group. Therefore, a toner powder having the above listed resins which are the most effective binder resins in respect of charging ability and durability can be utilized without any adverse effect of moisture. In consequence, the overall characteristics of the developer can be greatly improved by using the toner powder incorporating the above described resins.

Polyester resins that are used with advantage as a toner binder can be produced by condendation polymerization of alcohols and carboxylic acids. Suitable alcohols in clude diols such as ethylene glycol, diethylene glycol, triethylene glycol, 1,2-propylene glycol, 1,3-propylene glycol, 1,4-butane diol, neopentyl glycol, and 1,4-butene diol; 1,4-bis(hydroxymethyl)cyclohexane; etherified bisphenols such as bisphenol, hydrogenated bisphenol A, polyoxyethylenated bisphenol A and polyoxypropylenated bisphenol A; and divalent alcoholic monomers. Suitable carboxylic acids include maleic acid, fumaric acid, mesoconic acid, citraconic acid, itaconic acid, glutaconic acid, phthalic acid, isophthalic acid, terephthalic acid, cyclohexanedicarboxylic acid, succinic acid, adipic acid, sebacic acid, maloic acid, anhydrides thereof, dimers of lower alkyl esters and linoleic acid, and other divalent organic acid monomers.

Other suitable polyester resins are those polymers which contain components based on trifunctional and higher functional monomers. Illustrative trivalent and higher valent alcoholic monomers suitable as such polyfunctional monomers include sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methyl-propanetriol, 2-methyl-1,2,4-butanetriol, trimethylolethane, trimethylolpropane, and 1,3,5-trihydroxymethylbenzene.

Illustrative trivalent and higher valent carboxylic acid monomers include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-di-carboxyl-2-methylenecarboxypropane, tetra(methylenecarboxyl)methane, 1,2,7,8-octanetetracarboxylic acid, empol trimeric acid and anhydrides of these acids. The components based on these trifunctional and higher functional monomers are preferably contained in proportions ranging from 30 to 80 mol % of the alcoholic or acid component as a structural unit of the polymer.

Preferably, the polyester resins for use as a toner binder contain 5 to 25 wt % of the chloroform insoluble matter. The chloroform insoluble matter means the proportion of a specific sample of polyester resin that is dissolved in chloform and which is retained on filter paper. The content of the chloroform insoluble matter can be determined by the following method. A resin sample is finely ground and passed through a 40 mesh sieve. Five grams of the sample powder is put into a container (capacity: 150 ml) together with 5.00 g of a filtration aid, Radiolite #700. After pouring 100 g of chloroform, the container is rotated on a ball mill table for at least 5 hours until the sample is completely dissolved in chloroform. A filter disk (No.2, 7 cm$^{\phi}$) is put in a pressurized filter device and uniformly precoated with 5.00 g of Radiolite. After bringing the disc into intimate contact with the filter device by pouring a small amount of chloroform, the contents of the container are emptied into the filter device. The container is washed thoroughly with 100 ml of chloroform and the washings are poured into the filter device until no deposit is left on the container wall. Thereafter, the upper lid of the filter device is closed for starting filtration. During the filtration, the device is held at a pressure of 4 kg/cm$^2$ or less. When there is no further chloroform effluent, another 100 ml of chloroform is added to wash the residue on the filter disk in preparation for another cycle of pressure filtration. When all these procedures are completed, the filter disk, the residue and Radiolite on it are put on an aluminum foil and transferred into a vacuum drying chamber where the contents are dried at 80–100 C. and 100 mmHg for 10 hours. The total weight a of the dry solids (g) is measured and the contents of the chloroform insoluble matters X (wt %) is calculated by the following formula:

$$x\ (\text{wt }\%) = \frac{a\ (\text{g}) - \text{wt. of filter disk (g)} - \text{wt. of Radiolite (10.00 g)}}{\text{weight of the sample (5.00 g)}} \times 100$$

The chloroform insoluble matter whose content can be determined by the above procedures is a high-molecular weight polymeric component or a cross-linked polymeric component in a polyester resin and presumably has a molecular weight of 200,000 or more. The chloform insoluble matter can be formed in a reasonably controlled amount by properly selecting the conditions for condensation polymerization between the alcohols and carboxylic acids listed above, or by using a suitable crosslinking agent in the reaction system. If a polyester resin having less than 5 wt % of the chloroform insoluble matter is used, the resulting toner experiences offsetting at relatively low temperatures, and if the content of the chloroform insoluble matter exceeds 25 wt %, a toner having an increased softening point is obtained. In either case, the toner obtained is not suitable for fixing with a heat roller.

Styrene resins can also be used with advantage as a toner binder in the present invention. Suitable styrene resins are styrene homopolymers and copolymers of styrene and other vinyl monomers. Illustrative styrenes include styrene, chlorostyrene, and methylstyrene. Illustrative vinyl monomers include ethylenically unsaturated mono-olefins such as ethylene, propylene and isobutylene; vinyl halides such as vinyl chloride, vinyl bromide and vinyl fluoride; vinyl esters such as vinyl acetate; vinyl ethers such as vinyl methyl ether and vinyl ethyl ether; vinyl ketones such as vinyl methyl ketone and vinyl hexyl ketone; N-vinyl compounds such as N-vinyl pyrrole and N-vinyl pyrrolidone; acrylonitrile, methacrylonitrile and acrylamides. These vinyl comonomers may be used alone or in combination.

For providing a toner that has high charging ability, great durability and high developing ability and which hence can be used with advantage in the process of formation of a visible image, binder resins 60 wt % of which is accounted for by a styrene-acrylate copolymer, a styrene-methacrylate copolymer or a polyester resin are preferred. When the toner image is fixed by contact fusion using, say, a heat roller, the above listed copolymer resins preferably consist essentially of a high-molecular weight component and a low-molecular weight component, with a molecular weight distribution having two peaks in a mol. wt. curve, or with a suitable crosslinking agent to crosslink said resins. The reason is that a toner powder using a binder resin primarily made of these resins seldom experiences offsetting when the toner image is fixed.

The particles of the above listed binder resins contain colorants dispersed therein. To make a magnetic toner that is used as a one-component toner, magnetic particles may be incorporated in the binder resins instead of, or together with, colorants. Illustrative colorants include carbon black, Nigrosine (C.I. No. 50415 B), Aniline Blue (C.I. No. 50405), Chalcoil Blue (C.I. No. Azoec Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), and mixtures thereof. These colorants must be incorporated in a sufficient amount to provide a high-density visible image upon development, and usually, they are contained in an amount of from 1 to 20 parts by weight per 100 parts by weight of the binder resin.

Acidic, neutral and alkaline carbon blacks may be used either alone or in combination. An acidic carbon black is preferred because when it is used in combination with other carbon blacks, it can be uniformly dispersed in a binder resin in an amount greater than the other carbon blacks, with the result that a toner powder having a higher degree of blackness is obtained. However, if the acidic carbon black is used together with the second silicon dioxide powder of lower hydrophobicity rather than the first silicon dioxide powder of higher hydrophobicity, the inadequacy of the blocking of the hydrophilicity of unreacted silanol groups in the second silicon dioxide facilitates the formation of a stable hydrogen bond among the silanol group, the carbonyl or phenolic hydroxyl group in the acidic carbon black and ambient moisture, and the resulting toner is liable to the effect of ambient moisture. Therefore, for all the advantages of the acidic carbon black, it has been conventionally difficult to incorporate a large amount, of the acidic carbon black in the binder resin. But according to the present invention, the first silicon dioxide powder is essential and it is adequately hydrophobic since the hydrophilicity of any unreacted silanol group on the surface of an individual silicon dioxide particle is satisfactorily blocked. Therefore, a great amount of acidic carbon black can be incorporated in toner particles without incurring the disadvantages described above. The acidic carbon black as used herein is such that when a sample boiled in water is left to stand for a while, a supernatant having a pH of 5.0 or less is formed.

Examples of the magnetic particles that are incorporated to make a magnetic toner are ferromagnetic elements such as ferrite, magnetite, iron, cobalt and nickel; alloys or compounds containing these metals; and Mn-Cu base Heusler's alloys such as Mn-Cu-Al or Mn-Cu-Sn that do not contain ferromagnetic elements but which turn ferromagnetic upon heat treatment or other suitable treatment; and chromium dioxide. These magentic materials are generally contained in the binder resin as fine particles having an average size of 0.1 to 1 micron, and they are contained in an amount of 20 to 70 parts by weight, preferably from 40 to 70 parts by weight, per 100 parts by weight of the toner.

The binder resin powder may also contain other additives such as a charge control agent and an anti-offset agent which is used when contact fusion fixing is employed. A suitable anti-offset agent is a polyolefin having a softening point of 80° to 180° C. as measured by the ring and ball test, and polypropylene is particularly effective.

A toner that makes up the developer of the present invention can be prepared by mixing the toner powder described above with the first silicon dioxide powder which may be combined with the second silicon dioxide powder. This toner may contain a lubricant to prevent toner filming that occurs when toner particles are deposited on the surface of a support for latent electrostatic image. While many compounds are available as the lubricant, fatty acid metal salts are preferred. Among them are salts of maleic acid with metals such as zinc, magnesium and calcium; salts of stearic acid with metals such as zinc, cadmium, barium, lead, iron, nickel, cobalt, copper, aluminum and magnesium; lead dibasic stearate; salts of oleic acid with metals such as zinc, magnesium, iron, cobalt, copper, lead and calcium; salts of palmitic acid with metals such as aluminum and calcium; lead caprylate; lead caproate; salts of linolic acid with metals such as zinc and cobalt; calcium ricinoleate; salts of ricinoleic acid with metals such as zinc and cadmium; and mixtures thereof. Zinc stearate and calcium stearate are particularly preferred.

The developer of the present invention is made of the toner described above. When the toner contains a magnetic powder, it can be immediately used as a "one-component" developer. Alternatively, the toner may be combined with a carrier to form a "two-component" developer. Known carriers are iron powder and glass beads. Oxidized and unoxidized iron powders are used with advantage as electrically conductive carriers, and carrier nuclei made of magnetic materials such as iron, nickel, cobalt and ferrite and which are coated with insulating resins may be used with advantage as insulating carriers. The developer of the present invention may be made up of a mixture of two toner powders both of which contain magnetic particles but which have appreciably different particle sizes.

In the image forming method of the present invention, a latent electrostatic image formed on a support by a known technique such as electrophotography, electrostatic recording or electrostatic printing is developed with the developer described in the foregoing. For instance, in electrophotography, a drum 1 having a photoconductive photoreceptor on the surface is rotated clockwise as indicated by the arrow in the accompanying drawing, while static charges are imparted on the surface by a charging mechanism 2 such as a corona discharge device, and subsequently, the illuminated original is projected through an exposure mechanism 3 to form a latent electrostatic image on the photoreceptor, and by developing the latent image with a developing unit 4 filled with the developer of the present invention, a toner image is formed. A suitable method of development may be used depending upon the specific nature of the developer. When the developer is of a one-component type, fur brush development, impression development or powder cloud development may be used, and if a two-component developer is used, magnetic brush development or cascade development may be employed.

The resulting toner image is transferred onto a receiving sheet, usually paper. In the accompanying illustration, the receiving sheet is transported along a path P indicated by the one-long-and-one-short dash line, and the toner image is electrostatically transferred onto this sheet by means of a discharge device 5. The toner image may be transferred by pressure or with heat. The receiving sheet now carrying the transferred toner image is then transported to a fixing device where the toner image is fixed by contact fusion with a heat roller to thereby form a visible image.

The support from which the toner image has been transferred onto the receiving sheet is subjected to erase and cleaning steps in preparation for another cycle of image formation. In the illustration, the residual static charge on drum 1 is erased with a discharging device 6, and any toner particles left on drum 1 are eliminated by a cleaning mechanism 7 using a fur brush. Any cleaning method may be used, but to achieve the intended result, a conforming wiper blade or a fur brush is preferred since this is well compatible with high-speed image formation. The wiper blade is so positioned that its edge is placed in contact with the surface of a moving support, and cleaning with the wiper blade is simple and requires no suction to collect the removed toner. The wiper blade is so positioned that its edge is placed in contact with the surface of a moving support, and cleaning with the wiper blade is simple and requires no suction to collect the removed toner. The fur brush rotates in such a manner that it rubs against the surface of the support, and cleaning with the fur brush has the advantage of high efficiency.

As described in the foregoing, the present invention provides a developer made up of a toner comprising a mixture of toner particles with the first silicon oxide powder which is made hydrophobic due to the formation of a bond between a silicon atom having a specified organic group and a surface silicon atom through an oxygen atom. The present invention also provides a method of forming a visible image by using the new developer. As will be apparent from the examples that are described below, a developer having high fluidity which is retained for an extended period under hot and humid conditions can be prepared from a toner containing the first silicon dioxide powder optionally in combination with the second silicon dioxide powder. Since the developer will not experience blocking, it can be used over an extended period in consistently developing a latent electrostatic image to provide high resolution and sharpness. Therefore, the developer can provide visible images of consistently good quality for an extended period of time.

Since the developer of the present invention has improved resistance to moisture, the latitude in selecting a toner powder is expanded to such an extent that the high hygroscopicity of the toner powder is compensated by the present invention whereas the inherently good characteristics of the toner are exhibited to the fullest. Stated more specifically, the present invention is particularly effective in case of using a toner powder having a relatively high hygroscopicity, for example, one using a binder resin the primary component of which is a polymer having many hydrophilic functional groups such as a polyester resin, styrene-acrylate copolymer or a styrene-methacrylate copolymer, or one containing a colorant such as acidic carbon black which has a great content of hydrophilic carboxyl group or a phenolic hydroxyl group.

As a further advantage, the developer of the present invention hardly damages the support for an electrostatic latent image when it is used for an extended period. Therefore, it enables the support to exhibits its desired characteristics over an extended period, with the result that visible images of good quality having no fog, unevenness in density or streaks can be produced consistently. This advantage is still present when the support for latent electrostatic image is cleaned with a wiper blade or a fur brush. Therefore, the present invention permits the use of contact cleaning which is an effective way to clean the support, and by so doing, it increases the speed of image formation, more specifically, the moving speed of the support.

The developer of the present invention also has minimum chance to impair the support for electrostatic latent image even when the developer contains a waxy lubricant. Therefore, by incorporating a lubricant made of a fatty acid metal salt such as zinc stearate, toner filming on the surface of the support can be prevented without any adverse effect. Since the developer of the present invention has minimum chance to damage the support, a support that is vulnerable to scratches can be safely used in the present invention. In electrophotography, for instance, a light-conductive photoreceptor made of a selenium-tellurium system or a selenium-arsenic system, or one made of an organic photoconductive material such as polyvinyl carbazole may be used as a support having extended service life. For this reason, too, the developer of the present invention can be used for an extended period in forming visible images of consistently good quality. In short, the developer of the present invention has improved characteristics and yet has no adverse effects on the support for latent electrostatic image, and as a result, the various defects with the conventional developer are eliminated or reduced.

While the exact reason why the developer of the present invention has such excellent advantages is yet to be known, the first probable reason is that the organic group possessed by a silicon atom bonded to a silicon atom on the surface of an individual particle of the first silicon dioxide powder through an oxygen atom is made up of a relatively large atomic group or a long-chained atomic group. So, the particles of the first silicon dioxide are significantly more hydrophobic than the conventional product, and as a result, the overall resistance to moisture of the developer is greatly increased, and at the same time, the surface of individual particles of the first silicon dioxide is "wrapped" by a buffer, and the hardness of their surface is decreased to such an extent that the possibility of the powder to damage the support for latent electrostatic image is greatly reduced without sacrificing its activity as a lubricant. When the first silicon dioxide powder is used in combination with the second silicon dioxide powder, one more advantage is obtained, that is, the high fluidity of the developer.

The present invention is now described in greater detail by reference to the following examples which are given here for illustrative purposes only and are by no means intended to limit the scope of the invention.

When the first silicon dioxide powder is used alone

In Examples I to VIII, polyester resins A and B were used, and they were prepared by the following two methods, respectively.

Method 1

A round flask equipped with a thermometer, a stainless steel stirrer, a glass tube through which to introduce nitrogen, and a condenser was charged with 290 g of terephthalic acid, 211 g of polyoxypropylene(2,2)-2,2-bis(4-hydroxyphenyl)propane and 82 g of pentery-thritol. The flask was set in a mantle heater and heated while nitrogen gas was introduced into the flask to keep its interior under an inert atmosphere. Then, 0.05 g of dibutyl tin oxide was added, and reaction was carried out at 200° C. while the softening point was used as a parameter to monitor the progress of the reaction. As a result, polyester resin A with a chloroform insoluble content of 17 wt % was obtained. The resin had a ring and ball softening point of 131° C. as measured by the method specified in JIS K 1351-1960 (the same method was used in the following examples to determine the ring and ball softening point).

Method 2

Polyester resin B with a chloroform insoluble content of 12 wt % was produced as in Method 1 except that 828 g of polyoxypropylene (3,3)-2,2-bis(4-hydroxyphenyl)propane, 166 g of terephthalic acid and 127 g of benzene-1,2,4-tricarboxylic acid anhydride were used. The resin had a ring and ball softening point of 125° C.

EXAMPLE I

Preparation of comparative toner I-1

A hundred parts by weight of polyester resin A, 10 parts by weight of acidic carbon black ("Mogal-L" of Cabot Corporation), 2 parts by weight of an anti-offset agent ("Viscol 660P", or a polypropylene of Sanyo Chemical Industries, Ltd.) and 2 parts by weight of a fatty acid amide ("Hoechst Wax C" of Hoechst Japan Ltd.) were mixed, and by a conventional process for toner production consisting of heating, kneading, cooling, grinding and classification steps, toner powder I having an average particle size of 11 u was produced. It was immediately used as comparative toner I-1.

Preparation of comparative toner I-2

Comparative toner I-2 was prepared by mixing toner powder I with 0.8 wt % of fine particles of hydrophobic silicon dioxide having an average size of 20 mu ("Aerosil R-972" of Nippon Aerosil Co., Ltd.; 70 to 80% of the silanol groups on the $SiO_2$ particles was made hydrophobic by dimethyl silane).

Preparation of comparative toner I-3

Fine particles of hydrophobic silicon dioxide having an average size of 20mu wherein about 75% of the silanol groups on the $SiO_2$ particles (having 3 silanol groups per 100 $Å^2$) was made hydrophobic by reaction with propyl-dimethyl-chlorosilane were prepared, and 0.8 wt % of them was mixed with toner powder I to provide comparative toner I-3.

Preparation of comparative toner I-4

Fine particles of hydrophobic silicon dioxide having an average size of 20 mu were prepared as in the preparation of comparative toner I-3 except that the propyl-dimethyl-chlorosilane was replaced by benzyl-dimethyl-chlorosilane. Toner powder I was mixed with 0.8 wt % of these fine particles to prepare comparative toner I-4.

Preparation of toners I-1 to I-10

Ten samples of fine particulate hydrophobic silicon dioxide having an average size of 20 mu were prepared as in the production of comparative toner I-3 except that the propyl-dimethyl-chlorosilane was replaced by the organosilicon compounds listed in Table 1 below. Toner powder I was mixed with 0.8 wt % of the individual samples to produce toners I-1 to I-10.

TABLE 1

| | Organosilicon compounds |
|---|---|
| toner I-1 | dipentyl-dichlorosilane |
| toner I-2 | dihexyl-dichlorosilane |
| toner I-3 | dioctyl-dichlorosilane |
| toner I-4 | trioctyl-chlorosilane |
| toner I-5 | decyl-dimethyl-chlorosilane |
| toner I-6 | (cyclohexyl-methyl)-octyl-dichlorosilane |
| toner I-7 | dicyclohexyl-dichlorosilane |
| toner I-8 | didecyl-dichlorosilane |
| toner I-9 | didodecyl-dichlorosilane |
| toner I-10 | dihexadecyl-dichlorosilane |

Five parts by weight of each of comparative toners I-1 to I-4 and toners I-1 to I-10 was mixed with 95 parts by weight of a carrier made of spherical iron particles (average size: 100 u) coated with a styrene-acrylic resin. The so prepared 14 developers were checked for their fluidity and anti-blocking properties. They were also used in producing copies on plain paper set in an electrophotocopier U-Bix V (Konishiroku Photo Industry Co., Ltd.) using a seleium-arsenic photoreceptor and a cleaning blade. The quality of the initial copy and that of the 20,000th copy were checked. The results are shown in Tables 2 and 3.

TABLE 2

| | Fine $SiO_2$ powders | Fluidity | Anti-blocking properties |
|---|---|---|---|
| Comparative toner | | | |
| I-1 | none | 0.37 | x |
| I-2 | Aerosil R-972 | 0.46 | |
| I-3 | propyl-dimethyl-chlorosilane* | 0.45 | |
| I-4 | benzyl-dimethyl-chlorosilane* | 0.45 | |
| Toner | | | |
| I-1 | dipentyl-dichlorosilane* | 0.46 | |
| I-2 | dihexyl-dichlorosilane* | 0.46 | o |
| I-3 | dioctyl-dichlorosilane* | 0.47 | o |
| I-4 | trioctyl-chlorosilane* | 0.46 | o |
| I-5 | decyl-dimethyl-chlorosilane* | 0.46 | o |
| I-6 | (cyclohexyl-methyl)-octyl-dichlorosilane* | 0.46 | o |
| I-7 | dicyclohexyl-dichlorosilane* | 0.47 | o |
| I-8 | didecyl-dichlorosilane* | 0.46 | o |
| I-9 | didodecyl-dichlorosilane* | 0.46 | o |
| I-10 | dihexadecyl-dichlorosilane* | 0.47 | o |

*indicates the organosilicon compounds used to make the respective silicon dioxide powders hydrophobic.

The fluidity and anti-blocking properties of the respective toners were checked by the following methods.

Fluidity

A container (dia.: 50 mm, capacity: 100 ml) was coarsely filled with a sample of toner powder that was supplied overhead through a 24 mesh sieve. The weight of the container was measured to determine the bulk density of the powder. The greater the bulk density, the higher the fluidity of the toner.

Anti-blocking properties

A toner sample was left for 2 hours at 55° C. and 30% rh. The symbol o in Table 2 indicates no change to the toner; indicates the formation of an agglomerate that crumbled under the pressure of a finger; x indicates the formation of many agglomerates that would not crumble by the pressure of a finger.

TABLE 3

| | Initial copy | | 20,000th copy | | |
|---|---|---|---|---|---|
| | Fog | Uneven density/ streaking | Fog | Uneven density/ streaking | Sharpness |
| Comparative toner | | | | | |
| I-1 | 0.04 | x | 0.05 | x | x |
| I-2 | 0.01 | o | 0.01 | x | x |
| I-3 | 0.01 | o | 0.01 | x | x |
| I-4 | 0.01 | o | 0.01 | x | x |
| Toner | | | | | |
| I-1 | 0.01 | o | 0.01 | o | |
| I-2 | 0.01 | o | 0.01 | o | o |
| I-3 | 0.01 | o | 0.01 | o | o |
| I-4 | 0.01 | o | 0.01 | o | o |
| I-5 | 0.01 | o | 0.01 | o | o |
| I-6 | 0.01 | o | 0.01 | o | o |
| I-7 | 0.01 | o | 0.01 | o | o |

TABLE 3-continued

| | Initial copy | | 20,000th copy | | |
|---|---|---|---|---|---|
| | Fog | Uneven density/ streaking | Fog | Uneven density/ streaking | Sharpness |
| I-8 | 0.01 | o | 0.01 | o | o |
| I-9 | 0.01 | o | 0.01 | o | o |
| I-10 | 0.01 | o | 0.01 | o | o |

The fog, uneven density/streaking and sharpness for the respective toner samples were evaluated by the following methods (the same methods were used in the other examples).

Fog

The reflection density in the background was measured with a Sakura densitometer of Konishiroku Photo Industry Co., Ltd.

Uneven density/streaking

A large half-tone area which generally had a reflection density of 0.5 as measured with a Sakura densitometer of Konishiroku Photo Industry Co., Ltd. was selected, and checked for any uneven density and streaking. The symbol o in Table 3 indicates the absence of uneven density and streaking; indicates the presence of a slightly uneven density and some streaking; x indicates the presence of appreciable unevenness in density and many streaks.

Sharpness

The first copy was made from an original that was printed with printing types. The first copy was used as an intermediate to obtain the second copy. Subsequent copies were made until a clear image was no longer obtainable. The symbol o in Table 3 indicates that even the 7th copy had a sharp image with legible letters; indicates that the letters became illegible on the 4th to 6th copies; and x indicates that the letters became illegible on the 1st to 3rd copies.

EXAMPLE II

Preparation of comparative toner II-1

A hundred parts by weight of polyester resin B, 15 parts by weight of acidic carbon black ("Mogal-L" of Cabot Corporation) and 3 parts of an anti-offset agent (Hoechst Wax-OP of Hoechst Japan Ltd.) were mixed and the mixture was treated as in the preparation of comparative toner I-1 to produce toner powder II having an average particle size of 8 u. It was mixed with 0.2 wt % of zinc stearate (lubricant for preventing toner filming) to prepare comparative toner II-1.

Preparation of comparative toner II-2

Toner powder II was mixed with 0.8 wt % of fine particles of hydrophobic silicon dioxide having an average size of 20 mu ("Aerosil R-972" of Nippon Aerosil Co., Ltd.) to prepare comparative toner II-2.

Preparation of toners II-1 to II-10

Ten toner samples were prepared by blending toner powder II with the fine hydrophobic silicon dioxide powders and lubricants listed in Table 4. The respective toner samples were referred to as toners II-1 to II-10.

Twelve developer samples were prepared from comparative toners II-1 and II-2, as well as toners II-1 to II-10 as in Example I. They were used in producing copies on plain paper set in an electro-photocopier U-Bix V (Konishiroku Photo Industry Co., Ltd.) of the same type as used in Example I except that the selenium-arsenic photoreceptor was replaced by a selenium-tellurium photoreceptor. The quality of the initial copy and that of the 10,000th copy were checked. The results are shown in Table 4, wherein StZn represents zinc stearate and StCa, calcium stearate.

TABLE 4

| | Lubricant | | Fine $SiO_2$ powders | | Initial copy | | 10,000th copy | | |
|---|---|---|---|---|---|---|---|---|---|
| | Type | Amount (wt %) | Type | Amount (wt %) | Fog | Uneven density streaking | Fog | Uneven density/ streaking | Sharpness |
| Comparative toner | | | | | | | | | |
| II-1 | StZn | 0.2 | none | — | 0.01 | Δ | 0.04 | X | X |
| II-2 | StZn | 0.2 | Aerosil R-972 | 0.8 | 0.01 | o | 0.01 | X | X |
| toner | | | | | | | | | |
| II-1 | StZn | 0.025 | Dioctyl-dichlorosilane* | 0.8 | 0.01 | o | 0.01 | o | o |
| II-2 | StZn | 0.025 | Dioctyl-methyl-chlorosilane* | 0.8 | 0.01 | o | 0.01 | o | o |
| II-3 | StCa | 0.05 | Dioctyl-methyl-chlorosilane* | 0.8 | 0.01 | o | 0.01 | o | o |
| II-4 | StZn | 0.025 | Trioctyl-chlorosilane* | 0.8 | 0.01 | o | 0.01 | o | o |
| II-5 | StZn | 0.025 | Bis(4-t-butylphenyl)-dichlorosilane* | 0.8 | 0.01 | o | 0.01 | o | Δ |
| II-6 | StZn | 0.025 | Didecyl-dichlorosilane* | 0.8 | 0.01 | o | 0.01 | o | o |
| II-7 | StCa | 0.05 | Dioctyl-dichlorosilane* | 0.8 | 0.01 | o | 0.01 | o | o |
| II-8 | StZn | 0.05 | Dihexyl-octyl-chlorosilane* | 0.6 | 0.01 | o | 0.01 | o | o |
| II-9 | StZn | 0.5 | Didecyl-methyl-chlorosilane* | 0.6 | 0.01 | o | 0.01 | o | o |

*indicates the organosilicon compounds used to make the respective silicon dioxide powders hydrophobic.

EXAMPLE III

Toner powder III was prepared as in the production of toner powder I except that polyester resin A was replaced by a styrenemethyl methacrylate -n-butyl acrylate copolymer resin (Mw=95,000, Mn=9,500) that was formed by copolymerizing styrene, methyl methacrylate and n-butyl acrylate in a ratio of 80:5:15 (percent by weight). Fourteen developer samples were prepared from toner III as in Example I and checked for the quality of the images they produced. The results were almost the same as those obtained in Example I.

EXAMPLE IV

Four grams of a bisazo dye (Chlorodian Blue) was dissolved in a mixture of ethylenediamine (94 ml), n-butylamine (94 ml) and tetrahydrofuran (212 ml), and the resulting solution was coated onto the surface of an aluminum drum (120 mm$\phi$) to form a carrier generation layer 1 u thick. To a solution having 15 g of a polycarbonate resin dissolved in 100 ml of 1,2-dichloroethane, 11.25 g of a pyrazoline compound, i.e. 1-phenyl-3-(p-diethyl-methylaminophenyl)-5-(p-diethylaminophenyl)-pyrazoline was added, and the resulting solution was applied onto the carrier generation layer and dried at 60° C. over a period of 1 hour to form a carrier transport layer 13 u thick. The so prepared organic light-conductive photoreceptor was set in an electrophotocopier U-Bix V to check the quality of the copies obtained from this photoreceptor as in Example I. The results were substantially the same as those obtained in Example I. This demonstrates the effectiveness of the developer of the present invention for use with an organic light-conductive photoreceptor.

EXAMPLE V

A hundred parts by weight of polyester resin A, 10 parts by weight of each of the carbon black samples listed in Table 5, 2 parts by weight of an anti-offset agent (Viscol 660P, or a polypropylene of Sanyo Chemical Industries, Ltd.) and 2 parts by weight of a fatty acid amide (Hoechst Wax C of Hoechst Japan Ltd.) were mixed, and by a conventional process for toner production consisting of heating, kneading, cooling, grinding and classification steps, 10 samples of toner powder each having an average particle size of 10 u were produced. They were mixed with 1.0 wt % of the fine powders of hydrophobic silicon dioxide listed in Table 5 to produce 10 toner samples, five comparative toners V-1 to V-5 and five toners V-1 to V-5. Developers were prepared from these toners as in Example I and used in the production of copies in a similar manner. The quality of the 20,000th copy obtained with each developer is indicated in Table 5.

TABLE 5

| | Carbon black | | | | Uneven density/ | |
|---|---|---|---|---|---|---|
| | Type | pH | Fine $SiO_2$ powders | Fog | streaking | Sharpness |
| Comparative toner V-1 | | 2.5 | dimethyl-dichlorosilane* | 0.01 | X | X |
| Toner V-1 | " | " | Dioctyl-dichlorosilane* | 0.01 | o | o |
| Comparative toner V-2 | | 3.0 | Dimethyl-dichlorosilane* | 0.01 | X | X |
| Toner V-2 | " | " | Dioctyl-dichlorosilane* | 0.01 | o | o |
| Comparative Toner V-3 | | 2.5 | Dimethyl-dichlorosilane* | 0.01 | X | X |
| Toner V-3 | " | " | Dioctyl-dichlorosilane* | 0.01 | o | o |
| Comparative Toner V-4 | | 9.0 | Dimethyl-dichlorosilane* | 0.02 | X | X |
| Toner V-4 | " | " | Dioctyl-dichlorosilane* | 0.01 | o | Δ |
| Comparative Toner V-5 | | 7.5 | Dimethyl-dichlorosilane* | 0.02 | X | X |
| Toner V-5 | " | " | Dioctyl-dichlorosilane* | 0.01 | o | Δ |

*indicates the organosilicon compounds used to make the respective silicon dioxide powders hydrophobic.

As the above data shows, toners V-1 to V-5 according to the present invention were superior to comparative toners V-1 to V-5.

EXAMPLE VI

The toners prepared in Example I were used in copying with a U-Bix V of the same type as used in Example I except that the cleaning blade was replaced by a fur brush made of acrylic fibers. Similar results were obtained with respect to the quality of the initial copy and the 30,000th copy.

EXAMPLE VII

Preparation of toner powder A

Forty parts by weight of a styrene-butyl methacrylate copolymer resin prepared by copolymerizing styrene and butyl methacrylate in a ratio of 65:35 (percent by weight), 50 parts by weight of a magnetic powder (Mapicoblack BL-500 of Titan Kogyo Kabushiki Kaisha), 10 parts by weight of an ethylene-vinyl acetate copolymer resin (Ultracen-630 of Toyo Soda Manufacturing Co., Ltd.), 2 parts by weight of polypropylene (Viscol 660P of Sanyo Chemical Industries, Ltd.), 2 parts by weight of carbon black (MA-100 of Mitsubishi Chemical Industries Limited) and 1 part by weight of nigrosine dye (Oil Black BS of Orient Chemical Industry Co., Ltd.) were mixed, and by a conventional process for toner production consisting of heating, kneading, cooling, grinding and classification steps, magnetic toner powder A having an average particle size of 17 u was produced.

Preparation of toner powder B

Magnetic toner powder B was prepared as in the production of toner powder A except that the ethylene-vinyl acetate copolymer resin was not used.

Toner powders A and B were respectively mixed with the fine powders of hydrophobic silicon dioxide of the same type as used in producing toners I-1 to I-10 in Example I. The resulting 20 samples of the developer according to the present invention were used in producing copies on plain paper set in an electrophotocopier U-Bix T (Konishiroku Photo Industry Co., Ltd.) incorporating a magnetic toner development unit, a magnetic brush cleaning device and a zinc oxide photoreceptor. The quality of the initial copy and that of the 1,000th copy was checked. The image on either copy with each sample was sharp and none of them had fog or uneven density/streaking. The same results were obtained when the magnetic brush was replaced by a magnetic blade.

EXAMPLE VIII

Toner VIII-1 was prepared as in the production of toner I-3 in Example I except that in the preparation of a toner powder, polyester resin A was replaced by a phenolic resin having a ring and ball softening point of 130° C., the acidic carbon black "Mogal-L" by a neutral carbon black "Regal 660R" of Cabot Corporation.

Toner VIII-2 was also prepared as in the production of toner I-3 except that polyester resin A was replaced by a xylene resin having a ring and ball softening point of 129° C. and the acidic carbon black "Mogal-L" by a neutral carbon black "Regal 660R".

Five parts by weight of each toner was blended with 95 parts by weight of a magnetite carrier having an average particle size of 90 u. The resulting two developer samples were used in the production of copy images on plain paper set in an electrophotocopier U-Bix V of Konishiroku Photo Industry Co., Ltd. When the developer prepared from toner VIII-1 was used, 12,000 copies could be made, producing images similar to those obtained with toner I-3. When the developer from toner VIII-2 was used, similar results were obtained until 15,000 copies were made.

When both the first and second silicon dioxide powders are used

In the following examples, seven samples of the first $SiO_2$ powder and eight samples of the second $SiO_2$ powder were used. The seven samples of the first $SiO_2$ powder were prepared by rendering fine particles of hydrophilic $SiO_2$ hydrophobic with the organosilicon compounds listed in Table 6, and the eight samples of the second $SiO_2$ powder were prepared by rendering the same $SiO_2$ particles hydrophobic with the compounds listed in Table 7.

TABLE 6

| Symbol | First $SiO_2$ powder Organisilicon compounds |
|---|---|
| I-1 | dipentyl-dichlorosilane |
| I-2 | dioctyl-dichlorosilane |
| I-3 | didecyl-dichlorosilane |
| I-4 | didodecyl-dichlorosilane |
| I-5 | (cyclohexyl-methyl)-octyl-dichlorosilane |
| I-6 | trioctyl-chlorosilane |
| I-7 | decyl-dimethyl-chlorosilane |

TABLE 7

| Symbol | Second $SiO_2$ powder Organosilicon compounds |
|---|---|
| II-1 | 3-chloropropyl-trichlorosilane |
| II-2 | chloromethyl-trichlorosilane |
| II-3 | dimethyl-dichlorosilane |
| II-4 | trimethyl-chlorosilane |
| II-5 | chloromethyl-dimethyl-chlorosilane |
| II-6 | propyl-dimethyl-chlorosilane |
| II-7 | chlor-methyl-trichlorosilane |

EXAMPLE A

A hundred parts by weight of a styrene-butyl methacrylate copolymer resin that was prepared by copolymerizing styrene and butyl methacrylate in a weight ratio of 65:35 was used as a binder resin and mixed with 10 parts by weight of carbon black "#-30" of Mitsubishi Chemical Industries Limited. The mixture was subjected to a conventional process of toner production consisting of melting, kneading, cooling, grinding and classification steps. Five samples of toner powder having an average particle size of 12 u were prepared by this method. To the toner samples, a total of 0.8 wt % of the first and second $SiO_2$ powders listed in Table 8 (the first $SiO_2$ powders indicated by $SiO_2$-I, and the second $SiO_2$ powders by $SiO_2$-II) and a carrier made of iron particles (av. size: 100 u) coated with a styreneacrylic resin were added. The resulting 5 samples of the developer of the present invention each having a toner concentration of 2.0 wt % were referred to as samples A1 to A5.

Each sample was used in producing copies on plain paper set in an electrophotocopier U-Bix 4500 of Konishiroku Photo Industry Co., Ltd. incorporating a selenium-arsenic photoreceptor and a blade cleaning device. The quality of the initial copy and the 40,000th copy obtained with each sample is shown in Table 8.

COMPARATIVE EXAMPLE A

Comparative developer sample A1 was prepared as in Example A except that the toner powder was mixed with only $SiO_2$-II. The sample was subjected to the same copying test as in Example A. The results are also shown in Table 8.

TABLE 8

| Developer | $SiO_2$—I | $SiO_2$—II | Mixing ratio | Initial copy Fog | Initial copy Uneven density/streaking | 40,000th copy Fog | 40,000th copy Uneven density/streaking | 40,000th copy Sharpness |
|---|---|---|---|---|---|---|---|---|
| Sample A1 | I-2 | II-3 | 1:1 | 0.01 | o | 0.01 | o | o |
| Sample A2 | I-6 | II-4 | 1:1 | 0.01 | o | 0.01 | o | o |
| Sample A3 | I-3 | II-6 | 1:1 | 0.01 | o | 0.01 | o | o |
| Sample A4 | I-4 | II-5 | 1:4 | 0.01 | o | 0.01 | o | o |
| Sample A5 | I-3 | II-3 | 4:1 | 0.01 | o | 0.01 | o | o |
| Comparative sample A1 | — | II-3 | — | 0.01 | o | 0.01 | x | x |

The figures in the column "mixing ratio" indicate the weight ratio of mixing $SiO_2$-I with $SiO_2$-II. The fog, uneven-density/streaking and sharpness for each sample were evaluated as in Example I.

EXAMPLE B

Three samples of the developer of the present invention (Samples B1 to B3) were prepared as in Example A by using polyester resin A as a binder resin. Each sample was subjected to the same copying test as in Example A. The results are shown in Table 9.

COMPARATIVE EXAMPLE B

Comparative developer sample B1 was prepared as in Example B except that the toner powder was mixed with only $SiO_2$-II. The sample was subjected to the same copying test as in Example B. The results are also shown in Table 9.

TABLE 9

| Developer | $SiO_2$—I | $SiO_2$—II | Mixing ratio | Initial copy Fog | Initial copy Uneven density/streaking | 40,000th copy Fog | 40,000th copy Uneven density/streaking | 40,000th copy Sharpness |
|---|---|---|---|---|---|---|---|---|
| Sample B1 | I-1 | II-4 | 1:1 | 0.01 | o | 0.01 | o | o |
| Sample B2 | I-2 | II-3 | 1:1 | 0.01 | o | 0.01 | o | o |
| Sample B3 | I-3 | II-2 | 1:1 | 0.01 | o | 0.01 | o | o |
| Comparative sample B1 | — | II-4 | — | 0.01 | o | 0.01 | x | x |

EXAMPLE C AND COMPARATIVE EXAMPLE C

Three samples of the developer of the present invention (Samples C1 to C3) and one comparative sample C1 were prepared as in Example A and Comparative Example A, respectively, except that a styrene-butadiene copolymer that was prepared by coplymerizing styrene and butadiene in a weight ratio of 90:10 was used as a binder resin. The respective samples were subjected to same copying test as in Example A. The results are shown in Table 10.

TABLE 10

| Developer | $SiO_2$—I | $SiO_2$—II | Mixing ratio | Initial copy Fog | Initial copy Uneven density/streaking | 40,000th copy Fog | 40,000th copy Uneven density/streaking | 40,000th copy Sharpness |
|---|---|---|---|---|---|---|---|---|
| Sample C1 | I-2 | II-3 | 1:1 | 0.01 | o | 0.01 | o | o |
| Sample C2 | I-5 | II-1 | 1:1 | 0.01 | o | 0.01 | o | o |
| Sample C3 | I-7 | II-7 | 1:9 | 0.01 | o | 0.01 | o | o |
| Comparative sample C1 | — | II-3 | — | 0.01 | o | 0.01 | x | x |

EXAMPLE D

Three samples of the developer of the present invention (Samples D1 to D3)were prepared as in Example A except that the respective binder resins used were a styrene resin Picolastic E-125 of Esso Standars Sekiyu K.K., an epoxy resin Epikote 1004 of Shell Sekiyu K.K., and butyral resin Eslec BM-2 of Sekisui Chemical Co., Ltd. Each sample was subjected to the same copying test as in Example A. The results are shown in Table 11.

TABLE 11

| Developer | $SiO_2$—I | $SiO_2$—II | Mixing ratio | Initial copy Fog | Initial copy Uneven density/streaking | 40,000th copy Fog | 40,000th copy Uneven density/streaking | 40,000th copy Sharpness |
|---|---|---|---|---|---|---|---|---|
| Sample D1 | I-2 | II-3 | 1:1 | 0.01 | o | 0.01 | o | o |
| Sample D2 | I-2 | II-3 | 1:1 | 0.01 | o | 0.01 | o | o |
| Sample D3 | I-2 | II-3 | 1:9 | 0.01 | o | 0.01 | o | |

EXAMPLE E AND COMPARATIVE EXAMPLE E

Eight samples of the developer of the present invention (Samples E1 to E8) were prepared as in Example A except that the toner powder used in Example A was mixed with the samples of $SiO_2$-I and $SiO_2$-II listed in Table 12 and 0.1 wt % of zinc stearate (lubricant). The respective samples were used in producing copies on plain paper set in an electrophotocopier U-Bix 3000 of Konishiroku Photo Industry Co., Ltd. incorporating a selemiun-tellurium photoreceptor and a blade cleaning device. The results are shown in Table 12.

Two comparative doner samples E1 and E2 were prepared as in Comparative Example A except that the toner powder was mixed with 0.2 wt % of zinc stearate. Each comparative sample was also subjected to a copying test, and the results are shown in Table 12.

TABLE 12

| Developer | $SiO_2$—I | $SiO_2$—II | Mixing ratio | Initial copy Fog | Initial copy Uneven density/streaking | 40,000th copy Fog | 40,000th copy Uneven density/streaking | 40,000th copy Sharpness |
|---|---|---|---|---|---|---|---|---|
| Sample E1 | I-2 | II-3 | 1:1 | 0.01 | o | 0.01 | o | o |
| Sample E2 | I-4 | II-3 | 1:1 | 0.01 | o | 0.01 | o | o |
| Sample E3 | I-1 | II-4 | 1:1 | 0.01 | o | 0.01 | o | o |
| Sample E4 | I-7 | II-8 | 1:1 | 0.01 | o | 0.01 | o | o |
| Sample E5 | I-3 | II-7 | 1:1 | 0.01 | o | 0.01 | o | o |
| Sample E6 | I-2 | II-4 | 3:1 | 0.01 | o | 0.01 | o | o |
| Sample E7 | I-2 | II-1 | 3:1 | 0.01 | o | 0.01 | o | o |
| Sample E8 | I-3 | II-6 | 3:1 | 0.01 | o | 0.01 | o | o |

TABLE 12-continued

| Developer | $SiO_2$—I | $SiO_2$—II | Mixing ratio | Initial copy Fog | Initial copy Uneven density/ streaking | 40,000th copy Fog | 40,000th copy Uneven density/ streaking | 40,000th copy Sharp-ness |
|---|---|---|---|---|---|---|---|---|
| Comparative sample E1 | — | — | 3:1 | 0.01 | | 0.07 | x | x |
| Comparative sample E2 | — | II-3 | 1:3 | 0.01 | o | 0.01 | x | x |

EXAMPLE F

The developer samples prepared in Example A were used in copying with a U-Bix 4500 of the same type as used in Example A except that the cleaning blade was replaced by a fur brush made of acrylic fibers. Similar results were obtained with respect to the quality of the initial copy and 40,000th copy. When the same copy test wast conducted with comparative sample A1, the result were similar to those obtained in Comparative Example A.

EXAMPLE G

A light-conductive photoreceptor was prepared as in Example IV and subjected to a copying test as in Example A except that the photoreceptor was set in a modified model of an electrophotocopier U-Bix V. The results were substantially the same as those obtained in Example I. This fact shows the effectiveness of the developer of the present invention in use with an organic light-conductive photoreceptor.

EXAMPLE H

Toner powders A and B were prepared as in Example VII, and they were respectively mixed with the samples of $SiO_2$-I and $SiO_2$-II in the proportions used in the preparation of samples A1 to A5 in Example A. The resulting 10 samples of the one-component developer according to the present invention were used in producing copies on plain paper set in an electrophotocopier U-Bix T (Konishiroku Photo Industry Co., Ltd.) incorporating a magnetic toner development unit, a magnetic brush cleaning device and a zinc oxide photoreceptor. The quality of the initial copy and that of the 1,000th copy was checked. The image on either copy with each sample was sharp and none of them had fog or uneven density/streaking. Equally good results were obtained when the magnetic brush was replaced by a magnetic blade.

What is claimed is:

1. A developer for an electrostatic latent image comprising colored electroscopic particles and a first silicon dioxide powder wherein a silicon atom, having at least one organic group (A), is chemically bonded to a silicon atom on the surface of an individual silicon dioxide particle through an oxygen atom, said (A) being selected from the group consisting of a first saturated or unsaturated aliphatic organic group having at least 5 carbon atoms, and said first silicon dioxide powder is present in an amount of from 0.01 to 15% by weight based on said colored electroscopic particles.

2. A developer according to claim 1, wherein said colored electroscopic particles have an average particle size of 5 to 30μ.

3. A developer according to claim 1, wherein each particle of said first silicon dioxide powder has an average particle size of from 1 to 100 mμ.

4. A developer according to claim 1, wherein said colored electroscopic particles comprises a colorant dispersed in a binder resin which contains as a major component a polyester resin, a styrene-acrylate ester copolymer resin or a styrene-methacrylate ester copolymer resin.

5. A developer according to claim 4, wherein said polyester resin contains 5 to 25 wt % of a chloroform-insoluble matter.

6. A developer according to claim 4, wherein said styrene-acrylate ester copolymer resin and said styrene-methacrylate ester copolymer resin each consists essentially of a low-molecular weight component and a high-molecular weight component.

7. A developer according to claim 4, wherein said styrene-acrylate ester copolymer resin and said styrene-methacrylate ester copolymer resin are cross-linked.

8. A developer according to claim 4, wherein said colorant is a carbon black.

9. A developer according to claim 1, wherein said colored electroscopic particles comprise fine magnetic particles dispersed therein.

10. The developer of claim 1 wherein said organic group has at least 6 carbon atoms.

11. The developer of claim 1 further comprising a second silicon dioxide powder wherein a silicon atom, having at least one organic group (B), is bonded to a silicon atom on the surface of an individual silicon dioxide particle through an oxygen atom, said organic group (B) being selected from the group consisting of a third saturated or unsaturated aliphatic organic group having up to 4 carbon atoms and a fourth organic group having a hydrocarbon ring, wherein the total number of carbon atoms of said fourth organic group is no more than 7, said first and second silicon dioxide powders being in a weight ratio of 1:9 to 9:1 and the total of said first and second silicon dioxide particles present being 0.01% to 15% by weight based on said colored electrostatic particles.

12. The developer of claim 1 wherein one of said organic group (A) is selected from the group consisting of saturated and unsaturated aliphatic organic groups having at least 5 carbon atoms.

13. The developer of claim 1 wherein said first aliphatic organic group has at least 8 carbon atoms.

14. The developer of claim 1 wherein said first aliphatic organic group is an alkyl or alkenyl.

15. The developer of claim 1 wherein said aliphatic organic group having at least 5 carbon atoms is optionally interrupted with oxygen or nitrogen.

16. A developer according to claim 11, wherein said second silicon dioxide powder has an average particle size of from 1 to 100 mμ.

17. A developer according to claim 11, wherein said colored electroscopic particles comprise a colorant dispersed in a binder resin which contains as a major component a polyester resin, a styrene-acrylate ester copolymer resin or a styrene-methacrylate ester copolymer resin.

18. A developer according to claim 17, wherein said polyester resin contains 5 to 25 wt % of a chloroform-insoluble matter.

19. A developer according to claim 17 , wherein said styrene-acrylate ester copolymer resin and said styrene-methacrylate ester copolymer resin each consists essentially of a low-molecular weight component and a high-molecular weight component.

20. A developer according to claim 17, wherein said styrene-acrylate ester copolymer resin and said styrene-methacrylate ester copolymer resin are cross-linked.

21. A developer according to claim 17, wherein said colorant is a carbon black.

22. A developer according to claim 17, wherein said colored electroscopic particles comprise fine magnetic particles dispersed therein.

23. A method of forming an image comprising developing an electrostatic latent image on an image forming support with a developer which comprises colored electroscopic particles and a first silicon dioxide powder wherein a silicon atom, having at least one organic group (A), is chemically bonded to a silicon atom on the surface of an individual silicon dioxide particle through an oxygen atom, said group (A) being a first saturated or unsaturated aliphatic organic group having at least 5 carbon atoms, said first silicon dioxide powder being present in an amount of from 0.01% to 15% by weight based on said colored electroscopic particles, transferring said developed image to a receiving sheet and fixing the image thereon.

24. The method of claim 23 wherein said developer further comprises a second silicon dioxide powder wherein a silicon atom, having at least one organic group (B), is bonded to a silicon atom on the surface of an individual silicon dioxide particle through an oxygen atom, said organic group being selected from the group consisting of a third saturated or unsaturated aliphatic organic group having up to 4 carbon atoms and a fourth organic group having at least 1 hydrocarbon ring therein wherein the total number of carbon atoms in said fourth organic group, inclusive of the hydrocarbon ring, is no more than 7.

25. A method according to claim 23, wherein said support is a photoconductive material.

26. A method according to claim 25, wherein said photoconductive material is selenium.

27. A method according to claim 25, wherein said photoconductive material is an organic photoconductive material.

28. A method according to claim 23, which further includes the step of cleaning said support.

29. A method according to claim 28, wherein said cleaning is performed with a doctor blade or a fur brush.

* * * * *